US007255540B1

(12) United States Patent
Cooper

(10) Patent No.: US 7,255,540 B1
(45) Date of Patent: Aug. 14, 2007

(54) NATURAL GAS PROCESSING WELL HEAD PUMP ASSEMBLY

(76) Inventor: Jerry A. Cooper, R.R. 1, Box 101, Forgan, OK (US) 73938

( * ) Notice: Subject to any disclaimer, the term of this patent is extended or adjusted under 35 U.S.C. 154(b) by 494 days.

(21) Appl. No.: 10/852,871

(22) Filed: May 25, 2004

(51) Int. Cl.
*F04B 23/00* (2006.01)
*F04B 39/00* (2006.01)

(52) U.S. Cl. ..... 417/234; 417/313

(58) Field of Classification Search ..... 417/234, 417/126, 199.1, 130, 131, 313; 166/75.12, 166/90.1; 165/66, 47
See application file for complete search history.

(56) References Cited

U.S. PATENT DOCUMENTS

| | | | | |
|---|---|---|---|---|
| 2,758,665 | A | 8/1956 | Francis, Jr. | |
| 3,119,674 | A | 1/1964 | Glasgow | |
| 3,318,071 | A | 5/1967 | Sinex | |
| 4,198,214 | A | 4/1980 | Heath | |
| 4,342,572 | A | 8/1982 | Heath | |
| 4,421,062 | A | 12/1983 | Padilla, Sr. | |
| 4,511,374 | A | 4/1985 | Heath | |
| 4,579,565 | A * | 4/1986 | Heath | 95/15 |
| 4,617,030 | A | 10/1986 | Heath | |
| 4,674,446 | A | 6/1987 | Padilla, Sr. | |
| 4,686,938 | A | 8/1987 | Rhodes | |
| 4,689,053 | A | 8/1987 | Heath | |
| 5,442,924 | A | 8/1995 | Tsai | |
| 5,788,745 | A | 8/1998 | Hahn | |
| 6,302,967 | B1 * | 10/2001 | Rohrbacher et al. | 134/10 |

OTHER PUBLICATIONS

Minton, P. E. (1986). Handbook of Evaporation Technology. (pp. 153-165). William Andrew Publishing/Noyes. Online version available at: http://www.knovel.com/knovel2/Toc.jsp?BookID=264&VerticallD=0.*

* cited by examiner

*Primary Examiner*—Anthony D. Stashick
*Assistant Examiner*—Jessica Frantz
(74) *Attorney, Agent, or Firm*—Kenneth H. Jack; Davis & Jack, L.L.C.

(57) ABSTRACT

A gas processing well head pump assembly consisting of a reciprocating piston compressor pump having input and output ports; an internal combustion engine connected operatively to the compressor pump; a first gas conduit having a wall, a well head end, a pump end, and having an expanded bore between the well head and pump ends, the pump end being fixedly attached to the gas pump's input port, the wall having a first and at least a second aperture overlying the expanded bore; a second gas conduit having a pump end fixedly attached to the gas pump's output port, the second gas conduit entering the first gas conduit's expanded bore through the first aperture, and the second gas conduit exiting the expanded bore through the at least second aperture; and a natural gas liquids separator positioned within the first gas conduit's expanded bore.

10 Claims, 2 Drawing Sheets

NATURAL GAS PROCESSING WELL HEAD PUMP ASSEMBLY

FIELD OF THE INVENTION

This invention relates to apparatus and machinery for natural gas production. More particularly, this invention relates to natural gas well head pumping mechanisms and assemblies.

BACKGROUND OF THE INVENTION

Wells which produce non-associated natural gas commonly lack sufficient unassisted well head pressure to drive or convey the gas from the well into gas transmission pipelines. In such circumstances, the output conduit or pipe extending from such well head is commonly coupled with an input port of a gas driving pump such as a compressor pump. The operation of such pump reduces the effect of atmospheric pressure which opposes existing naturally occurring natural gas well head pressure. In addition to enhancing the rate of flow of gas from a natural gas well, such compressor pumps advantageously provide a step up in gas pressure to a level sufficient for injection of the gas into natural gas transmission pipelines.

A problem associated with utilization of such compressor pumps at natural gas well heads stems from the fact that non-associated natural gas which emanates from a natural gas well typically comprises by product substances in addition to methane such as ethane, propane, butane, iso-butane, natural gasoline, crude oil, water, and, on occasion, solid particulate matter. Any or all of such non-methane natural gas components may precipitate at the point of the compressor pump, potentially jamming the pump or fouling and degrading the lubricating fluid in the compressor pump's oil reservoir. Also, where temperatures are low, natural gas hydrates tend to form solid or semi-solid compounds resembling ice crystals which potentially foul or interfere with the function of such compressor pump.

The instant inventive natural gas well head pump assembly solves or ameliorates the problems discussed above by providing a well head pump which utilizes otherwise wasted heat energy emanating from such compressor pump for warming natural gas prior to its arrival at the pump, and by providing means upstream of such pump for separating natural gas liquids.

BRIEF SUMMARY OF THE INVENTION

A first structural component of the instant inventive gas processing well head assembly comprises a gas pump having an input port and an output port. Suitably, the gas pump may comprise a centrifugal pump or a rotary pump. However, preferably, the gas pump comprises a reciprocating piston pump.

A further structural component of the instant invention comprises motor means connected operatively to the gas pump. Where electric power is available at a natural gas well, the motor means may suitably comprise an electric motor. Preferably, the motor means comprises a four cycle internal combustion engine adapted for burning methane gas, which is always available at the well. A small portion of the compressed natural gas output of the preferred reciprocating gas pump may be pressure controlled and may be diverted or channeled to the fuel/air intake of such motor. Preferably, a pulley and belt assembly is utilized as a drive linkage between such motor and the pump.

A further structural component of the instant invention comprises a first natural gas conveying conduit which extends from a natural gas well head to the intake port of the gas pump. Necessarily, such conduit includes an expanded bore situated at a point between the well head and the pump's intake port, such bore necessarily defining an interior space large enough for the occurrence therein of thermal exchanges of heat. Necessarily, the first gas conduit has a first and at least a second aperture for entry and exit of a heat exchange tube within the expanded bore. Preferably, the section or portion of the first gas conduit which includes the expanded bore comprises an enlarged heat exchange tank.

A further structural component of the instant invention comprises a second gas conduit coupled with and extending from the gas pump's output port. The second gas conduit necessarily extends from the pump and extends into and through the first conduit's first aperture, then exiting from such conduit's at least second aperture. Preferably, for purposes of enhanced heat exchange within the expanded bore of the first gas conduit, that portion of the second gas conduit which resides within the first gas conduit preferably follows a multiple series of bends and back turns or, suitably and alternately, follows a helical path.

Liquids separating means within the expanded bore of the first gas conduit are necessarily provided. Suitably, the liquids separating means may comprise multiply angled surfaces of the bent or wound second gas conduit extending within the expanded bore of the first gas conduit. Preferably, the liquid separating means comprises a volume of small metal pieces, shards or fragments which cumulatively present a multiplicity of gas impingement faces through and around which the natural gas may pass, and against which small droplets of natural gas liquids may coalesce. Coalesced natural gas liquids precipitate downwardly to a lower end of the heat exchange tank.

The combined function of the separator and the heat exchange tank causes fluids conveyed to the compressor pump to be "dry" or gaseous, protecting the pump from fouling and breakdown.

Natural gas liquids which flow to the bottom of the preferred heat exchange tank preferably exit therefrom through a purging port, and then flow through a conduit to a natural gas liquids collector tank. Preferably, means are provided for automatically and periodically purging the contents of the collector tank into a larger storage tank.

Accordingly, an object of the instant invention comprises the provision of a well head pump assembly having gas pump input and output conduits adapted for thermally routing compressor pump heat for warming natural gas flowing to the gas pump.

Other and further objects of the instant invention have been described above, and are further described below in the Detailed Description and appended drawings which follow.

DETAILED DESCRIPTION OF A PREFERRED EMBODIMENT

Figure 1:
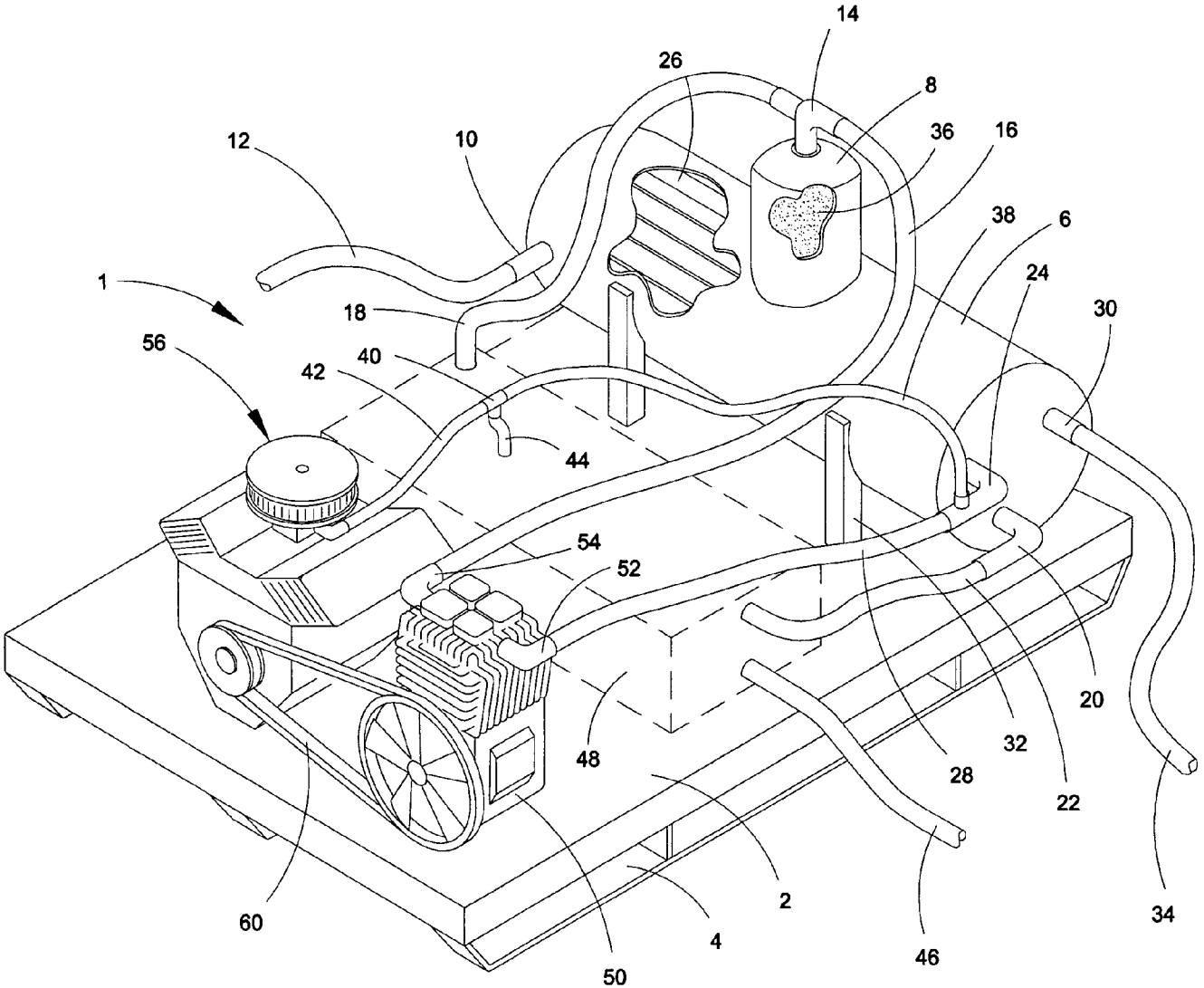
FIG. 1 is an isometric view of a preferred embodiment of the instant inventive gas processing pump assembly.

Referring now to the drawings, and in particular to FIG. 1, the instant inventive gas processing pump assembly is referred to generally by Reference Arrow 1. Non-associated natural gas may flow from a natural gas well head (not depicted) to the assembly 1 via gas transmission conduit 12. Such non-associated natural gas then flows into the interior space of a heat exchange tank 6, the gas entering through such tank's well head end port 10. The gas then flows over and across heat exchange tubes 26 and thence upwardly through a screened aperture within the wall of tank 6 (such aperture not within view) to enter an upwardly extending natural gas liquids separating chamber 8.

Referring further to FIG. 1, the interior space of the natural gas liquids separating chamber 8 is preferably filled with a volume of corrosion resistant metal pawl rings, pieces, or fragments 36, such fragments presenting a multiplicity of variously positioned and angled surfaces against which the natural gas may impinge and flow around, promoting coalescence of natural gas liquids. Thereafter, the natural gas which has been stripped of natural gas liquids exits the natural gas liquids separating chamber 8 through "T" joint 14, the majority of such gas routing into gas conduit 16.

Referring further to FIG. 1, a reciprocating piston compressor pump 50 is preferably provided, such pump having a low pressure gas input port 54, and having a high pressure gas output port 52. Relatively low pressure natural gas from the well head side of the system flows into the low pressure port 54 via gas conduit 16.

Referring further to FIG. 1, a reciprocating piston internal combustion engine is preferably provided, such engine being referred to generally by Reference Arrow 56. The engine 56 drives compressor 50 via a pulley and belt drive linkage 60. The compressor pump 50 pumps the low pressure natural gas received from gas conduit 16 through output port 52 for further transmission as high pressure gas through gas conduit 28. The high pressure gas then passes through "T" joint 24 and enters the interior space of heat exchange tank 6 through a first aperture within the wall of said tank 6, such aperture preferably being filled and hermetically sealed by "T" joint 24. Thereafter, the high pressure natural gas flows through heat exchange tubes 26 through a plurality of bends and back turns. After the occurrence of heat exchange, the high pressure gas exits heat exchange tank 6 through a second aperture filled by port sleeve 30 to flow through output conduit 34 to, for example, a natural gas storage tank or a natural transmission pipeline (not depicted).

Referring further to FIG. 1, work performed by compressor 50 upon natural gas imparts heat energy to the natural gas, causing gas flowing through conduit 28 and through heat exchange tubes 26 to be warmer than gas which initially flows from the well head through conduit 12. Through thermal conduction, such heat energy passes from heat exchange tube 26 to the low pressure gas flowing through the interior space of heat exchange tank 6 warming such gas. Such warming effect beneficially prevents crystallization in cold weather of any natural gas hydrates which may flow through the gas conduits of the assembly. Such warming effect, working in combination with the natural gas liquids separator 8, also beneficially reduces the amount of natural gas liquids flowing through conduit 16 to compressor 50, protecting the compressor from breakdowns and fouling.

Figure 2:
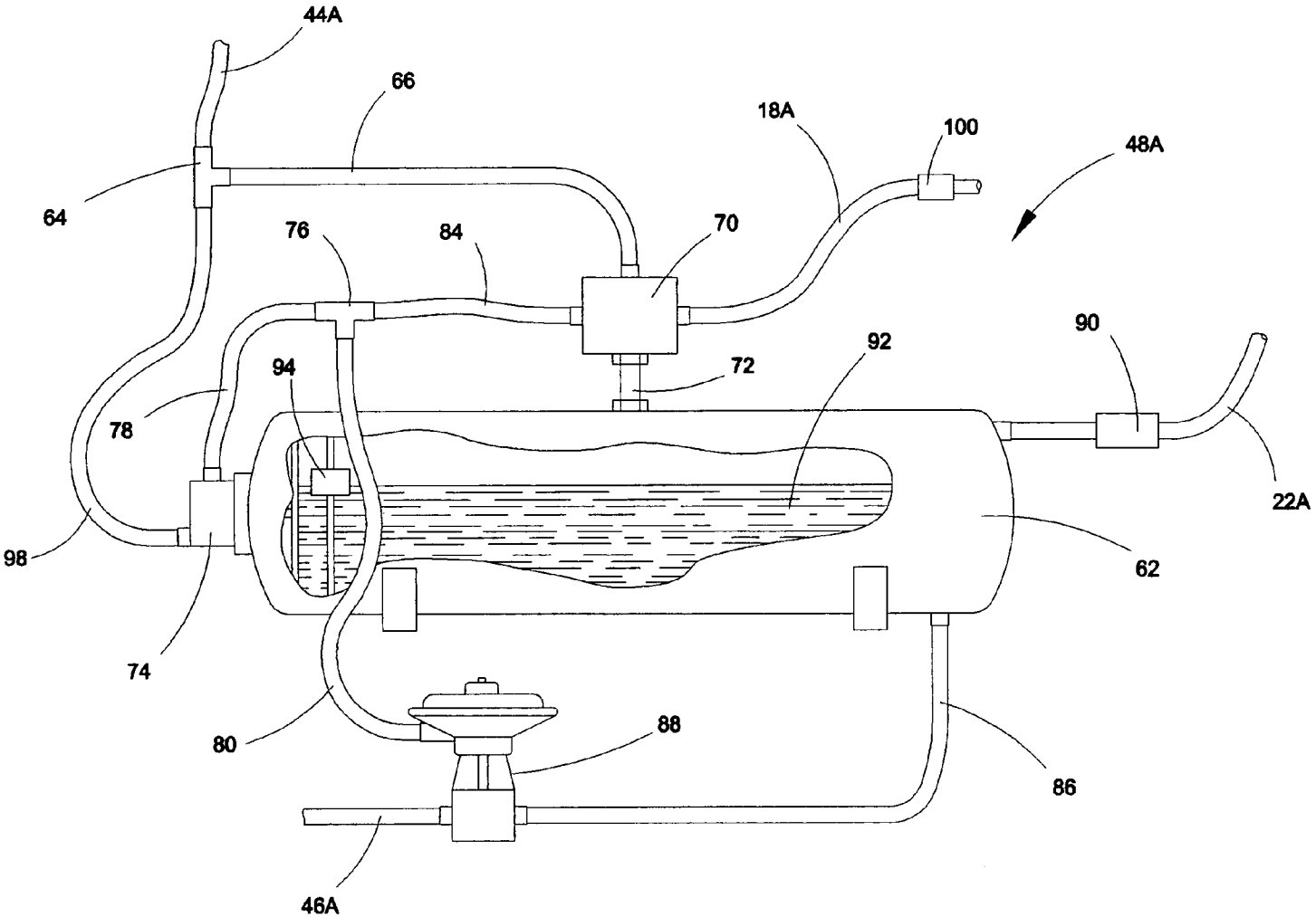
FIG. 2 is a detailed view of the natural gas liquids collection and purging sub-assembly of the assembly depicted in FIG. 1.

Referring simultaneously to FIGS. 1 and 2, the dashed line representational box 48 signifies and representationally encases the natural gas liquids collection and automatic purging assembly depicted in FIG. 2. Reference Numerals in FIG. 2 having "A" suffixes are continuous with similarly numbered fluid conduits appearing in FIG. 1.

Natural gas liquids which coalesce and precipitate within the natural gas liquids separating chamber 8 flow downwardly through the aperture (preferably a screened aperture) at the floor of chamber 8. Such liquids then flow to the floor of heat exchange chamber 6.

Referring further simultaneously to FIGS. 1 and 2, such separated natural gas liquids collected at the floor of heat exchange tank 6 exit such tank at a low point output port 20 to flow through a separated fluids conduit 22/22A to enter a natural gas liquids collection tank 62. Preferably, a back flow checking valve 90 assures that natural gas liquids flowing to tank 62 through conduit 22/20A can only enter such tank. Preferably, tank legs 32 raise the heat exchange tank 6 to a level such that the separated liquids output port 20 overlies the input of conduit 22A to tank 62, providing for gravity purging of separated natural gas liquids.

Referring further simultaneously to FIGS. 1 and 2, in operation of the natural gas liquids collection and automatic purging system 48, natural gas liquids 92 which are separated from the non-associated natural gas flowing from the well head line 12 collect within the interior space of tank 62. As the level of the natural gas liquids 92 rises within tank 62, a valve actuating float 94 buoyantly rises and, upon reaching a pre-determined upper level, actuates and opens a float actuated valve 74. Upon opening of valve 74, high pressure gas flowing from conduit 38 and through "T" joint 40 into conduit 44/44A travels across "T" joint 64, and through conduit 98. Thereafter, the gas flows through float actuated valve 74, through conduit 78, across "T" joint 76, and then through conduit 84 for actuation of a three port flow selector valve 70. The high pressure gas within conduit 84 acts as a pilot actuator turning valve 70 from its normal position wherein fluid flow between conduits 72 and 18A is maintained, to a high pressure position wherein high pressure gas from conduit 66 is allowed to flow through valve 70 and thence through conduit 72 to enter the interior space of tank 62 filling such tank with high pressure gas overlying the natural gas liquids 92.

Referring further simultaneously to FIGS. 1 and 2, conduit 46/46A typically extends to a pressurized natural gas liquids storage tank. A diaphragm actuated valve 88 is normally closed, preventing such pressurized liquids from backwardly flowing through conduits 46/46A and 86 into the interior of tank 62. Upon opening of float actuated valve 74, a portion of the high pressure gas which arrives at "T" joint 76 flows through conduit 80 to open bladder valve 88, allowing the high pressure gas emanating from conduit 72 and into the interior space of tank 62 to overcome tank pressure within conduit 46/46A, driving the natural gas liquids 92 through conduit 86 and through conduit 46/46A into such natural gas liquids storage tank.

Referring further simultaneously to FIGS. 1 and 2, upon purging of natural gas liquids 92, float 94 buoyantly falls, closing the float actuated valve 74, and causing the pressure within conduit 84 to drop. Such pressure drop allows selector valve 70 to return to its normal position wherein a fluid flow path between conduit 18/18A and 72 is maintained. A check valve 100 is preferably interposed in line with conduit 18/18A for preventing backward flow into tank 62. Such fluids flow path equalizes pressure between the low pressure well head input line 12 and the interior of tank 62, allowing for gravity flow of separated natural gas liquids through conduit 22/22A.

Referring to FIG. 1, conduit 42 preferably extends from high pressure "T" joint 40, serving as a fuel supply for engine 56.

Referring further to FIG. 1, a mobile platform 2 having downwardly extending slide skids 4 preferably supports the compressor 50, the engine 56, the natural gas liquids collection and purging system 48, and the heat exchange tank 6.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A gas processing pump assembly comprising:

(a) a gas pump having input and output ports;

(b) motor means connected operatively to the gas pump;

(c) a first gas conduit comprising a heat exchange tank having a wall, a well head end, a pump end, and having an expanded bore between the well head end and the pump end, the pump end being fixedly attached to the gas pump's input port, the wall having a first and at least a second aperture;

(d) a second gas conduit having a pump end fixedly attached to the gas pump's output port, the second gas conduit entering the heat exchange tank's expanded bore through the first aperture, the second gas conduit exiting said expanded bore through the at least second aperture; and (e) liquids separating means within the first gas conduit's expanded bore; the heat exchange tank's interior space comprising a first and at least a second chamber, the second gas conduit extending along a plurality of bends within the first chamber and the liquids separating means being within the at least second chamber, the pump end of the heat exchange tank being positioned at the at least second chamber.

2. The gas processing pump assembly of claim 1 wherein the gas pump comprises a compressor pump.

3. The gas processing pump assembly of claim 1 wherein the motor means comprises an internal combustion engine or an electric motor.

4. The gas processing pump assembly of claim 1 wherein the liquids separating means comprises a multiplicity of gas flow diverting surfaces.

5. The gas processing pump assembly of claim 4 wherein the heat exchange tank has upper and lower ends, the at least second chamber being positioned at the heat exchange tank's upper end.

6. The gas processing pump assembly of claim 1 wherein the heat exchange tank has a lower end, and wherein said tank has a liquids purging port positioned at the lower end of said tank.

7. The gas processing pump assembly of claim 6 further comprising a liquids conduit and a liquids collection tank, the liquids conduit spanning between the heat exchange tank's liquids purging port and the liquids collection tank.

8. The gas processing pump assembly of claim 7 further comprising automatic liquids purging means connected operatively to the liquids collection tank.

9. The gas processing pump assembly of claim 7 further comprising a mobile platform, the gas pump, the motor means, the heat exchange tank, and the liquids collection tank being mounted upon the mobile platform.

10. The gas processing pump assembly of claim 1 further comprising a mobile platform, the gas pump, the motor means, and the first gas conduit's expanded bore being mounted upon the mobile platform.

* * * * *